US007285725B1

(12) United States Patent
Saman

(10) Patent No.: US 7,285,725 B1
(45) Date of Patent: Oct. 23, 2007

(54) WEATHERPROOF AND RESTRAINING APPARATUS FOR ELECTRICAL PLUGS

(76) Inventor: Rick Saman, 3205 Kathleen St., Baytown, TX (US) 77520

( * ) Notice: Subject to any disclaimer, the term of this patent is extended or adjusted under 35 U.S.C. 154(b) by 0 days.

(21) Appl. No.: 11/385,523

(22) Filed: Mar. 21, 2006

Related U.S. Application Data

(60) Provisional application No. 60/664,227, filed on Mar. 22, 2005.

(51) Int. Cl.
*H01R 4/00* (2006.01)

(52) U.S. Cl. ..... 174/84 R; 174/88 R; 174/92; 174/93

(58) Field of Classification Search ..... 174/74 R, 174/74 A, 76, 79, 84 R, 84 S, 85, 92, 93
See application file for complete search history.

(56) References Cited

U.S. PATENT DOCUMENTS 4,535,197 A * 8/1985 Butler ..... 174/41
4,643,505 A * 2/1987 House et al. ..... 439/369
4,702,541 A 10/1987 Arnold
5,211,573 A * 5/1993 Cross ..... 439/369
5,217,387 A * 6/1993 Hull et al. ..... 439/367
5,299,951 A 4/1994 Blaetz
5,306,176 A 4/1994 Coffey
5,347,084 A * 9/1994 Roney et al. ..... 174/92
5,368,500 A 11/1994 Dedering
5,561,269 A * 10/1996 Robertson et al. ..... 174/92
5,569,882 A * 10/1996 Yokoyama et al. ..... 174/76
5,594,210 A * 1/1997 Yabe ..... 174/76
5,674,089 A * 10/1997 Sampson ..... 439/521
5,696,351 A * 12/1997 Benn et al. ..... 174/92
5,755,588 A * 5/1998 Sweatman et al. ..... 439/369
5,813,879 A 9/1998 Russo
5,834,690 A * 11/1998 Bastiaansen ..... 174/564
5,844,171 A * 12/1998 Fitzgerald ..... 174/92
6,036,526 A * 3/2000 Alfis, III ..... 439/369
6,190,207 B1 2/2001 Wang
6,250,946 B1 6/2001 Tardy
6,407,338 B1 * 6/2002 Smith ..... 174/92
D481,361 S 10/2003 Barnes

* cited by examiner

*Primary Examiner*—William H. Mayo, III
(74) *Attorney, Agent, or Firm*—Robert C. Montgomery

(57) ABSTRACT

An apparatus having an upper half with at least one upper clasp and a lower half hingedly connected to the upper half. The upper half and the lower half has a connector cavity and a cable channel, configured to receive a cord and a cord plug. The upper half and the lower half further has two opposed two holes for allowing cable access to the cable channel. Outer edges of the upper half and the lower half has a perimeter having sealant running continuous across an entire perimeter of all edges. Upon closing the upper half and the lower half, the apparatus becomes totally sealed.

6 Claims, 7 Drawing Sheets

WEATHERPROOF AND RESTRAINING APPARATUS FOR ELECTRICAL PLUGS

RELATED APPLICATIONS

The present invention was first described in U.S. Provisional Patent Application No. 60/664,227 filed on Mar. 22, 2005. There are no previously filed, nor currently any co-pending applications, anywhere in the world.

FIELD OF THE INVENTION

The present invention relates generally to an apparatus that connects cords, and more particularly, to an apparatus that provides a waterproof covering of joints and also provides a mechanism for preventing the inadvertent disconnection of electrical cords.

BACKGROUND OF THE INVENTION

Exterior extension cords are typically used to connect electrical loads that are located a good distance away from the nearest electrical outlet. They are typically used with power tools, yard care equipment, holiday lighting arrangements and the like. While they do their job fairly well, they are prone to be coming accidentally disconnected. Also, while Ground Fault Circuit Interrupters (GFCI's) may prevent accidental shocks, not all extension cords are plugged into such circuits. Also, even if cords are plugged into GFCI's, nuisance tripping will occur if the connection becomes wet.

Several attempts have been made in the past to provide a housing for storing coupled electrical cords within a weather-resistant enclosure. U.S. Pat. No. 6,250,946 in the name of Tardy discloses a sealable extension cord plug cover with a resilient foam interior. The Tardy invention discloses an entire deformable foam insulation interior, which is an excess of material not necessary for the present invention.

U.S. Pat. No. 5,813,879 issued in the name of Russo provides a four-part accessory for securing onto both the male and female plug connections of electrical cords. Each accessory consists of two parts that are matably connected to each other and subsequently mated to the opposing two-part assembly. Along with the obvious disadvantage of having four separate parts, each half is installed over the corresponding female or male plug portion via mating elements such as screws. This greatly increases the effort and labor involved, not to mention the possibility of lost hardware.

U.S. Pat. No. 5,368,500 issued in the name of Dedering describes an adaptable closure for protecting an electric plug extending from a vehicle consisting of a hinged assembly with opposing halves and a retaining ring. The Dedering invention is particularly concerned with protecting the non-deployed portion of a female vehicle electrical plug, which is much different in scope and use than in the present invention.

U.S. Pat. No. 5,306,176 issued in the name of Coffey discloses a protection device for the mating plug and socket connectors of electrical plugs and consists of a tubular housing with each ends of an electrical cord fed through a retaining end for threading onto each ends of the tubular housing. The threaded ends of the Coffey invention allow the plugs to be pulled apart while remaining inside the tubular housing. The present invention is a hinged one-piece assembly that does not have additional parts to lose or account for.

U.S. Pat. No. 5,299,951 issued in the name of Blaetz describes a housing assembly consisting of a two-part central housing joined together by a "quick-release" connection with two threaded end caps similar in function to the Coffey invention.

U.S. Pat. No. 4,702,541 issued in the name of Arnold describes an extension cord connector guard with a reclosable access door and a rotatable latch. A pivoting gate provides means for securing differently-sized electrical connector plugs and sockets. The preponderance of movable parts and general bulkiness of the Arnold invention are disadvantages not seen in the present invention.

None of the prior art particularly describes a weatherproof and water-resistant electrical cord connection apparatus that not only retains the coupling of two (2) electrical cords, but also effectively protects them from inclement weather and unwanted interrupted electrical service from water damage. Accordingly, there exists a need for a means by which the electrical connection of extension cord plugs and receptacles can be protected from unintentional unplugging as well as contact with energized parts by water.

SUMMARY OF THE INVENTION

It is therefore an object of the invention to provide a system for keeping the electrical connections in situ and protecting the connections from any form of water other unfavorable artificial or natural conditions.

To achieve above and other objectives the present invention provides an apparatus for weatherproof restraining and providing improved fastening of electrical connections comprising; a box open-able in at least two halves receiving electrical cables for connecting them characterized in that the box is provided with a waterproofing and fastening ring at one or both the opening edges of the two halves of the box.

The invention in particular provides a weatherproof restraining apparatus for cord-mounted electrical plug and receptacle systems. This is an apparatus that holds two cords, together. The invention takes the form of a plastic box the box snaps open into two halves along its length, using an integral hinge, hinges, or plastic clasps. Two openings are made on the small faces of the box through which the cord ends are routed. In one exemplar embodiment, each half has a semi-circular opening on each small face. Thus when each half is closed, the semi-circular openings close to form a circular opening on each small face of the box. The electrical cord fits within each of the circular openings.

The opening edges of the box are lined with high density foam rubber which serves two purposes. First, the foam rubber holds the cords captive via friction and prevents the cords from coming apart. Second, the foam rubber prevents water, snow, dirt and other contaminants from gaining access to the plug assemblies, thus preventing possible electrocution.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
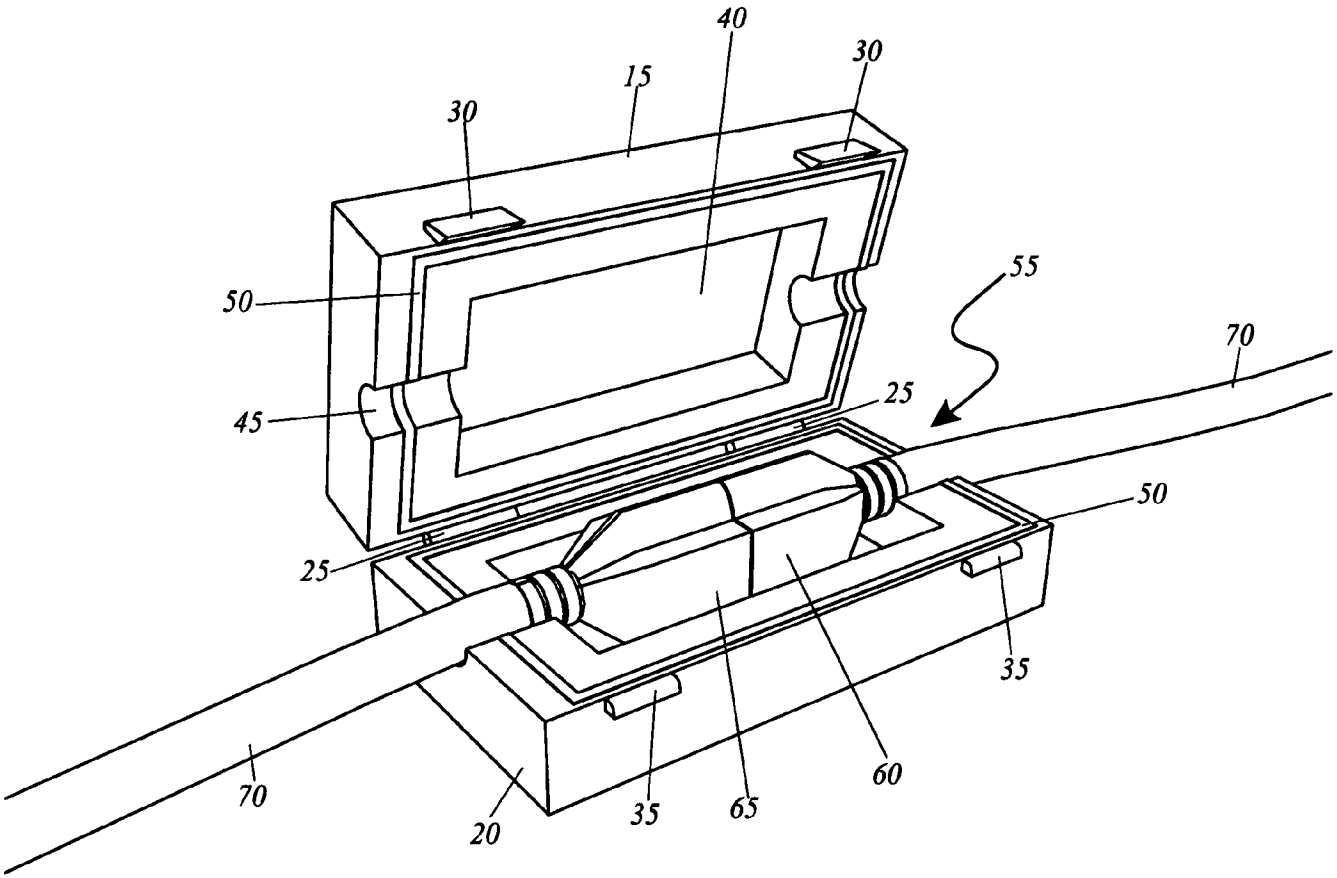
FIG. 1 is a pictorial view of the weatherproof restraining apparatus for cord mounted electrical plug and receptacle systems 10, shown in an open state with a cord set 55, according to the preferred embodiment of the present invention; and, FIG. 2 is a pictorial view of the weatherproof restraining apparatus for cord mounted electrical plug and receptacle systems 10, shown in a closed state with a cord set 55; and, FIG. 3 is a perspective view of the weatherproof restraining apparatus for cord mounted electrical plug and receptacle systems 10, shown in an open state.

10 weatherproof restraining apparatus or cord mounted electrical plug and receptacle systems
15 upper half
20 lower half
25 connecting hinge
30, upper clasp
35 lower connecting appurtenance
40 connector cavity
45 cable channel
50 sealant
55 cordset
60 male electrical connector
65 female electrical connector
70 cable

DETAILED DESCRIPTION OF THE PREFERRED EMBODIMENT

The best mode for carrying out the invention is presented in terms of its preferred embodiment, herein depicted within the FIGS. 1 through 7. However the invention is not limited to the described embodiment and a person skilled in the art will appreciate that many other embodiments of the invention are possible without deviating from the basic concept of the invention any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Referring first to FIG. 1, a pictorial view of the weatherproof restraining apparatus for cord mounted electrical plug and receptacle systems 10, in an open state, according to the preferred embodiment of the present invention is disclosed. The weatherproof restraining apparatus for cord mounted electrical plug and receptacle systems 10 consists of an upper half 15 and lower half 20, both of which are generally box-like and the same overall size. It is envisioned that the overall size of the upper half 15 and lower half 20, when snapped together would be approximately 1½ inches square and four inches long for a common cordset connection.

However, it should be noted that the size of the weatherproof restraining apparatus for cord mounted electrical plug and receptacle systems 10 may vary depending upon its applications and other varying conditions, and as such, should not be interpreted as a limiting factor of the present invention. The upper half 15 and the lower half 20 are joined together by a connecting hinge 25, with a quantity of two or more as indicating in FIG. 1, or by a continuous hinge that runs the length of the intersection of the upper half 15 and lower half 20. It is envisioned that the connecting hinge 25 would be molded as an integral component of the weatherproof restraining apparatus for cord mounted electrical plug and receptacle systems 10 to aid in reduced manufacturing costs, and to ensure the integrity of the weatherproof restraining apparatus for cord mounted electrical plug and receptacle systems 10. When closed, the upper half 15 and the lower half 20 are held captive by an upper clasp 30 on the upper half 15, which connects via friction fit to a lower connecting appurtenance 35 on the lower half 20 in a well-known manner.

Similar to the connecting hinge 25, the upper clasp 30 and the lower connecting appurtenance 35 would be molded as an integral component of the upper half 15 and lower half 20 respectively. The upper half 15 and the lower half 20 each contain a half of one connector cavity 40 and a half of two cable channels 45. The functionality of the connector cavity 40 and the cable channel 45, will be described in greater detail herein below, but generally houses a male and female electrical connector along with corresponding cables in a mated position.

The perimeter of the outer edges of the upper half 15 and the lower half 20 are lined with a sealant 50 such as foam rubber, silicone, rubber, or the like. The sealant 50 is continuous around the perimeter of all edges, included those defined by the cable channel 45. The sealant 50 provides multiple functionality by holding the cables from the electrical connectors captive via friction, thus preventing the connection from becoming disengaged. Additionally, the sealant 50 prevents water, snow, dirt and other contaminants from gaining access to the connector cavity 40 where they could foul or otherwise violate the integrity of the electrical connection.

Figure 2:
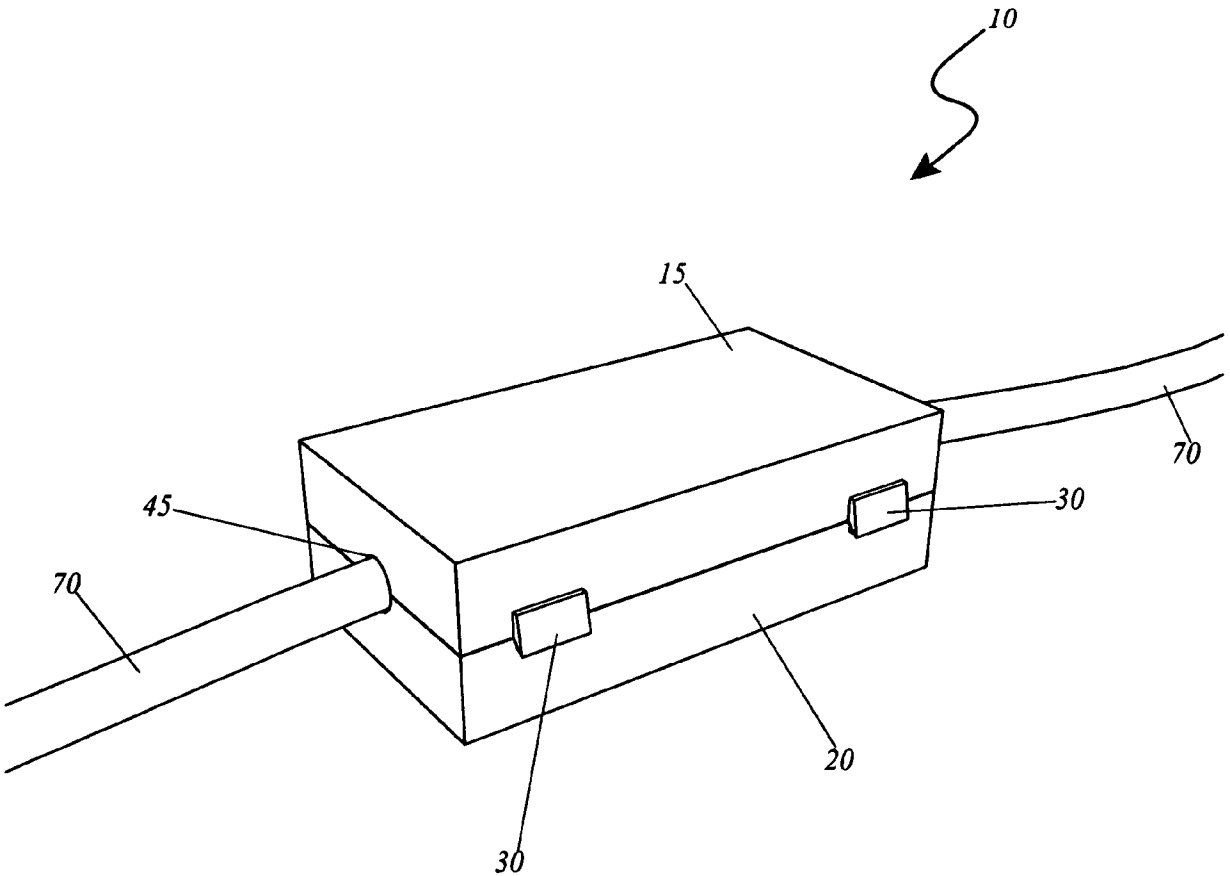
Figure 3:
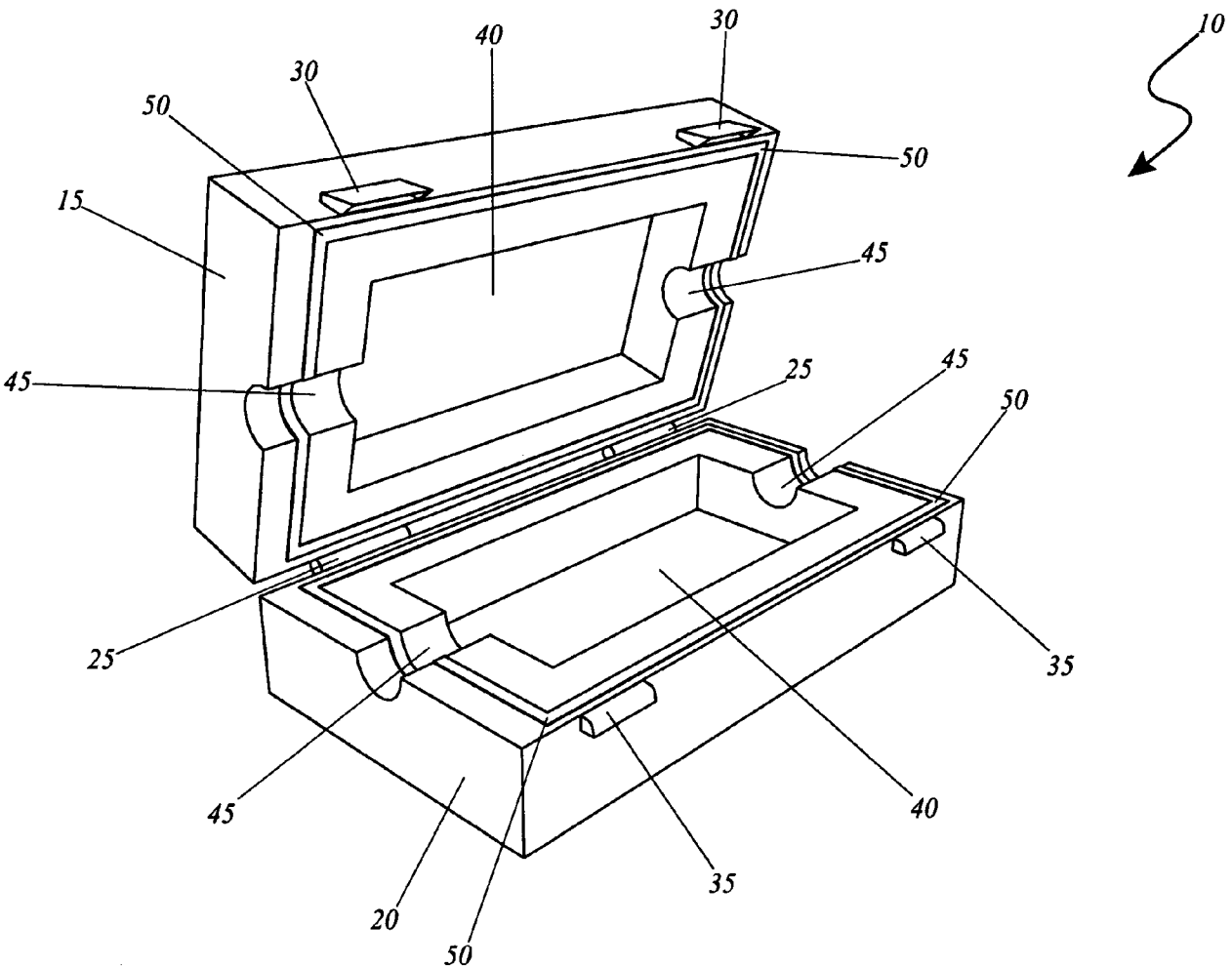
Figure 4:
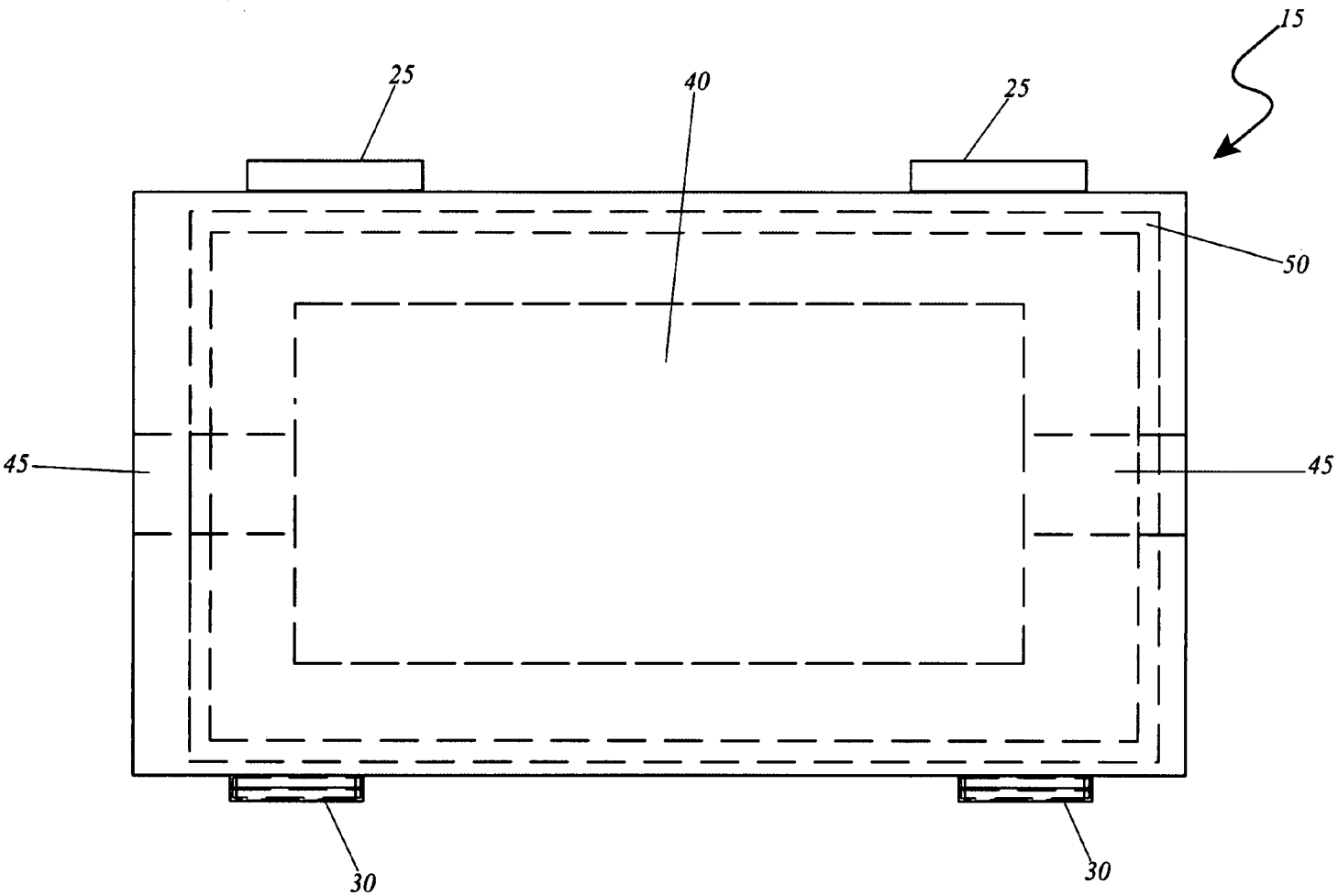
FIG. 4 is a top view of the weatherproof restraining apparatus for cord mounted electrical plug and receptacle systems 10, shown with interior details; and, FIG. 5 is a front view of the weatherproof restraining apparatus for cord mounted electrical plug and receptacle systems 10; and, FIG. 6 is a rear view of the weatherproof restraining apparatus for cord mounted electrical plug and receptacle systems 10; and, FIG. 7 is a side view of the weatherproof restraining apparatus for cord mounted electrical plug and receptacle systems 10.
Figure 5:
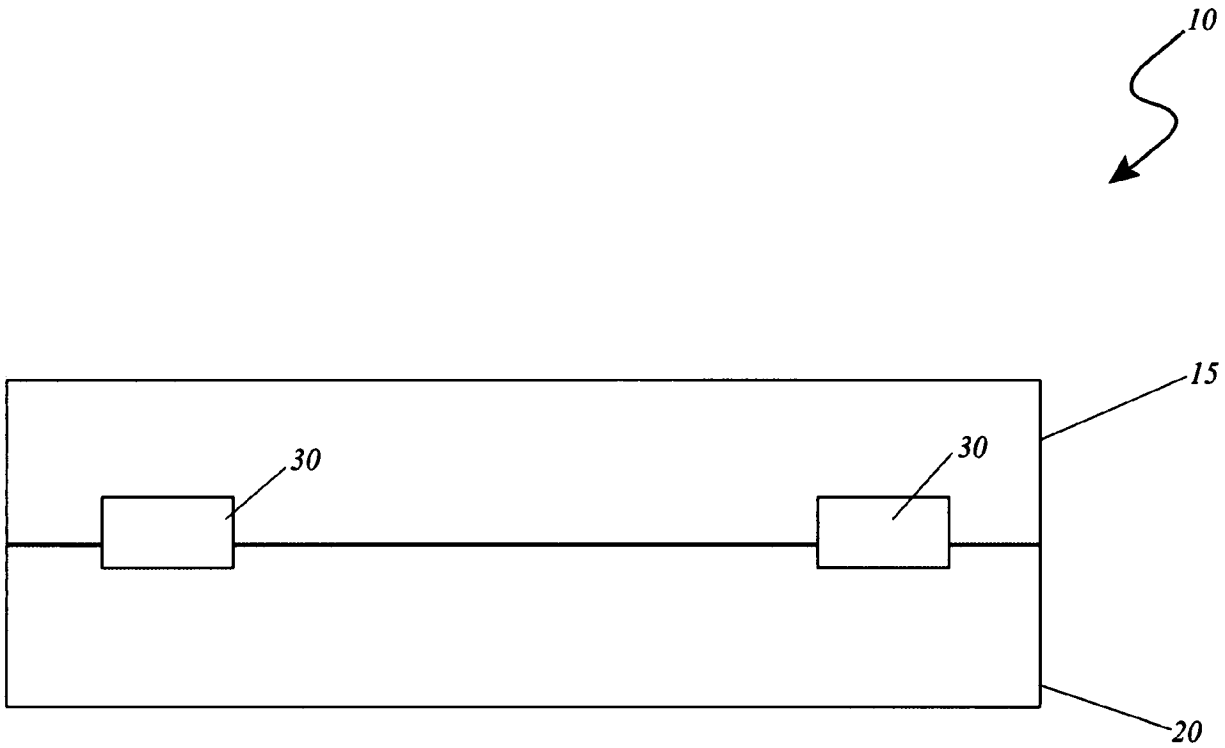
Figure 6:
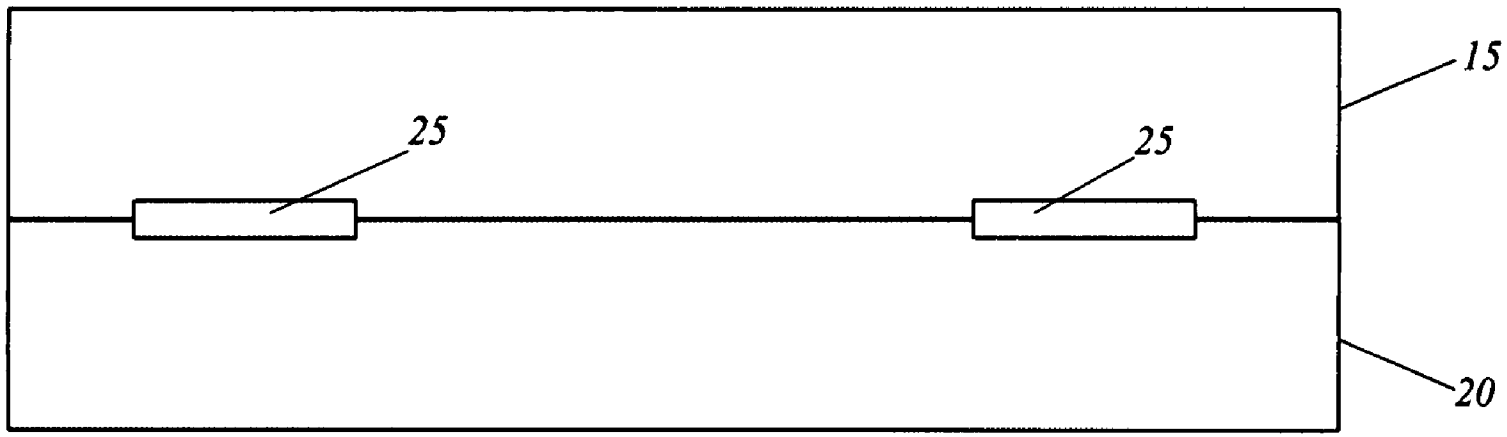
Figure 7:
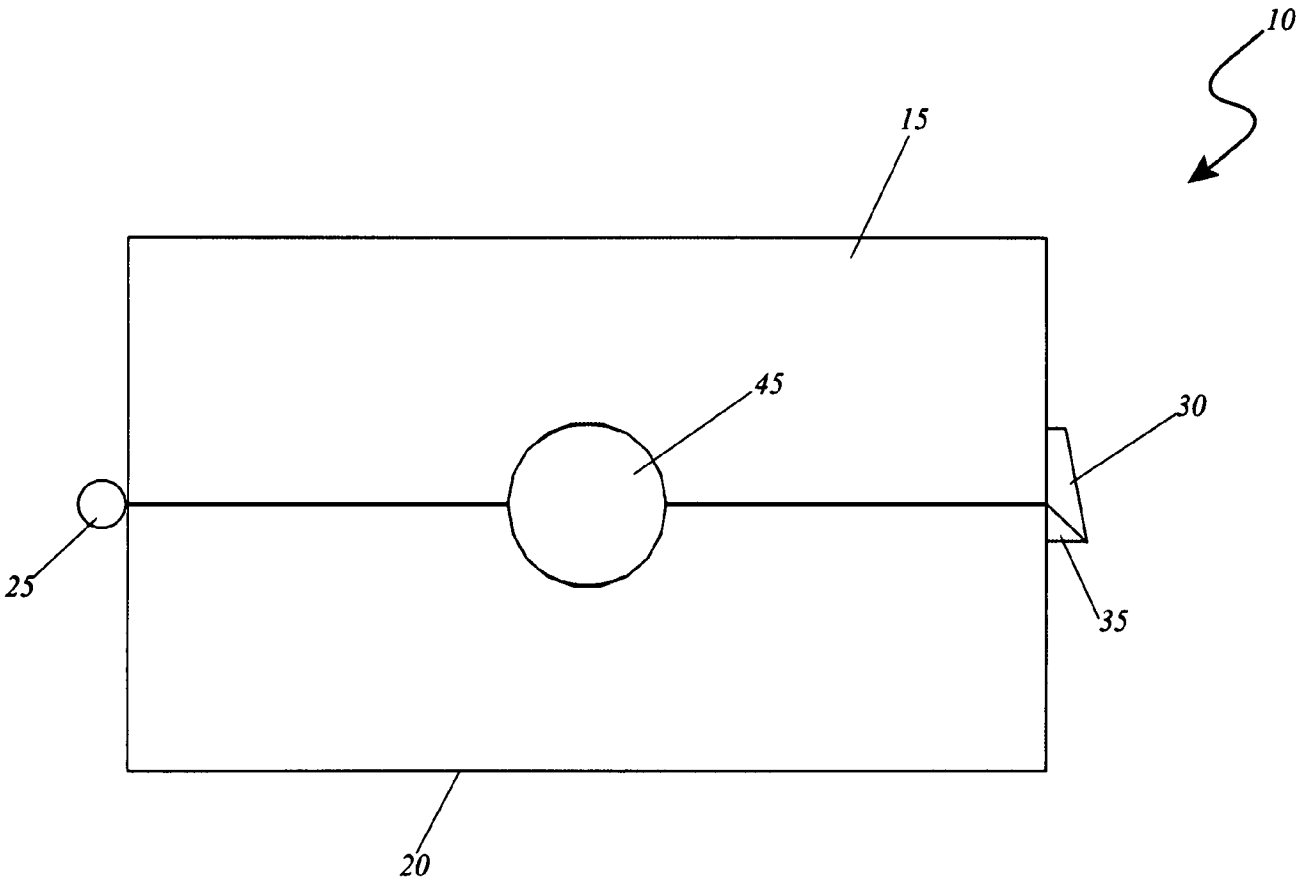

Referring next to FIG. 2, an isometric view of the weatherproof restraining apparatus for cord mounted electrical plug and receptacle systems 10 shown in a partially utilized state, with a cordset 55 is depicted. The cordset 55 comprises a male electrical connector 60 and a female electrical connector 65 along with their corresponding cable 70. The cordset 55 is depicted as a common NEMA 5-15R power connection commonly found in residential, commercial and industrial environments typically used for carrying 120 VAC power to various electrical devices. However it should be noted that the weatherproof restraining apparatus for cord mounted electrical plug and receptacle systems 10 can be used for power connections of all voltages, types, and ampacities, and for signal connections such as those used for sound reinforcement, computer networks and the like, and as such, should not be interpreted as a limiting factor of the present invention.

FIG. 2 clearly shows that when the upper half 15 and the lower half 20 are closed and mated, the connector cavity 40 holds the male electrical connector 60 and the female electrical connector 65 in their captive position and unable to become disengaged without first opening the weatherproof restraining apparatus for cord mounted electrical plug and receptacle systems 10. Additionally, the barrier formed by the sealant 50 presents a waterproof barrier which completely encases the cordset 55 from their cable 70 and their associated electrical connection. As such, the weatherproof restraining apparatus for cord mounted electrical plug and receptacle systems 10 is ideal for use with holiday lighting arrangements, power tools, yard equipment or any device that is typically connected to an extension cord in a wet environment.

Referring now to FIGS. 3 through 7, show various elevation views for the apparatus 10. Although these figures represent the best mode of the invention, it is anticipated and envisioned that other embodiments may also represent the present invention. In particular, different connection means for the upper clasp 30 and lower connecting appurtenance 35 may be provided, such as, but not limited to, magnetic means, buckles, and locks. Also, the hinge 25 may be a one-part or two-part device. Deformable foam may provide the sealant means.

The preferred embodiment of the present invention can be used by the common user in a simple and effortless manner, with minimal training. After purchase or procurement of the weatherproof restraining apparatus for cord mounted electrical plug and receptacle systems 10 it is ready for use on any typical cordset 55 that may be exposed to accidental disconnection and/or wet environments. To use the weatherproof restraining apparatus for cord mounted electrical plug and receptacle systems 10, the user would first connect the male electrical connector 60 and the female electrical connector 65 together in a typical fashion. Next, the mated connectors are placed within the connector cavity 40 such that the cable 70 from the male electrical connector 60 and the cable 70 from the female electrical connector 65 are routed within the cable channel 45.

Finally, the upper half 15 and the lower half 20 are snapped shut and secured via the upper clasp 30 and the lower connecting appurtenance 35 on the upper half 15 and lower half 20 respectively. At this point the weatherproof restraining apparatus for cord mounted electrical plug and receptacle systems 10 along with the associated cordset 55 is ready for use in its aforementioned protected state.

To remove the weatherproof restraining apparatus for cord mounted electrical plug and receptacle systems 10 from the cordset 55, the installation process is reversed, by removing the weatherproof restraining apparatus for cord mounted electrical plug and receptacle systems 10 from the cord set 55 whereupon the male electrical connector 60 and the female electrical connector 65 can be unmated. At this point the cycle is completed; the weatherproof restraining apparatus for cord mounted electrical plug and receptacle systems 10 is ready for use again.

The invention is intended for use with variety of applications including holiday lighting arrangements, power tools, yard equipment or any device that is typically connected to an extension cord in a wet environment. The use of the invention provides an effective means of securing an electrical connection to an extension cord in a manner which is not only quick and easy, but safe as well.

It is further envisioned that the present invention may provide weatherproofing and retaining means for a variety of electrical connections and cables, such as, but not limited to, computer cables, coaxial cables, 220-volt electrical plugs and sockets, and extension electrical cords.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, to thereby enable others skilled in the art to best utilize the invention and various embodiments with various modifications as are suited to the particular use contemplated. It is understood that various omissions, substitutions of equivalents are contemplated as circumstance may suggest or render expedient, but is intended to cover the application or implementation without departing from the spirit or scope of the claims of the present invention. It is intended that the scope of the invention be defined by the Claims appended hereto and their equivalents. Therefore, the scope of the invention is to be limited only by the following claims:

What is claimed is:

1. An apparatus for weatherproof restraining and providing improved fastening of electrical connections comprising:

an upper half having at least one upper clasp;

a lower half hingedly connected to said upper half, said lower half having at least one lower connecting appurtenance, said lower connecting appurtenance adapted to secure to said upper clasp to close said upper half and said lower half;

said upper half and said lower half each having a connector cavity and a cable channel to receive a cord and cord plug, said connector cavity and said cable channel aligned to receive a cable and plug;

said upper half and said lower half each having two opposed two holes in each small face to allow the cable access to said cable channel of each of said upper half and said lower half;

said upper half and said lower half each having an inside face;

said inside face having a perimeter;

said perimeter of said upper half and said lower half having a sealant disposed continuously around the perimeter, whereby when said upper half and said lower half are joined, by closing the apparatus, the sealant of the upper half and the sealant of the lower half are substantially aligned to resist water and debris from entering said upper half and said lower half.

2. The apparatus of claim 1 wherein said connector cavity is of a perimeter large enough to retain a plurality of sizes of a cord and cord plug.

3. The apparatus of claim 1 wherein said cable channel is of a diameter large enough to retain a plurality of sizes of cables.

4. The apparatus of claim 1, wherein the sealant further comprises a deformable foam material that compresses to form a water-resistant and debris-resistant barrier whenever said upper half and said lower half are joined.

5. The apparatus of claim 1, wherein said upper half and said lower half further comprise varying silhouettes, sizes, and decors to accommodate fashion.

6. A method for the weatherproof restraining and fastening of electrical connections, comprising steps of:

placing a weatherproof restraining and improved electrical connection fastening apparatus adjacent to a male end of a first electrical cord and a female end of a second electrical cord;

opening said apparatus by disconnecting an upper clasp attached to an upper half from a lower connecting appurtenance attached to a lower half and hingedly rotating said upper half apart from said lower half, thereby allowing access to a first connector cavity of said upper half and a second connector cavity of said lower half;

mating said male end of said first electrical cord to said female end of said second electrical cord to create a cordset;

placing said cordset within either said first or second connector cavity;

closing said apparatus by hingedly rotating said upper half towards said lower half, and connecting said upper clasp to said lower connecting appurtenance; and, compressing a sealant located peripherally about said first and second connector cavity upon closing of said apparatus, said sealant disposed continuous around a perimeter.

* * * * *